United States Patent [19]

Abthoff et al.

[11] 4,000,614

[45] Jan. 4, 1977

[54] MIXTURE COMPRESSING INTERNAL COMBUSTION ENGINE WITH TWO CYLINDER ROWS AND EXHAUST GAS TREATMENT

[75] Inventors: Jörg Abthoff, Pluderhausen; Dag-Harald Hüttebräucker, Endersbach, both of Germany

[73] Assignee: Daimler-Benz Aktiengesellschaft, Germany

[22] Filed: Jan. 23, 1976

[21] Appl. No.: 651,817

[30] Foreign Application Priority Data

Feb. 8, 1975 Germany ..... 2505339

[52] U.S. Cl. ..... 60/276; 60/285; 123/119 R; 123/119 DB

[51] Int. Cl.[2] ..... F01N 3/15; F02B 75/10

[58] Field of Search ..... 60/276, 285; 123/119 R, 123/119 D, 119 DB

[56] References Cited

UNITED STATES PATENTS

| | | | |
|---|---|---|---|
| 3,698,371 | 10/1972 | Mitsuyama | 123/119 DB |
| 3,827,237 | 8/1974 | Linder | 60/276 |

*Primary Examiner*—Douglas Hart
*Attorney, Agent, or Firm*—Craig & Antonelli

[57] ABSTRACT

A mixture-compressing reciprocating-piston internal combustion engine with two separate cylinder rows and a single mixture-producing device, in which one row is supplied with a slightly richer air/fuel mixture from a common mixture-producing device which is then leaned down by the admixture of additional air while the other cylinder row is supplied with an air/fuel mixture which is as accurately as possible stoichiometric; oxygen probes are thereby used upstream of the respective catalysts to control a valve controlling the additional air inlet to the one cylinder row and the fuel supply to the mixture-producing device.

16 Claims, 2 Drawing Figures

Figure 1:
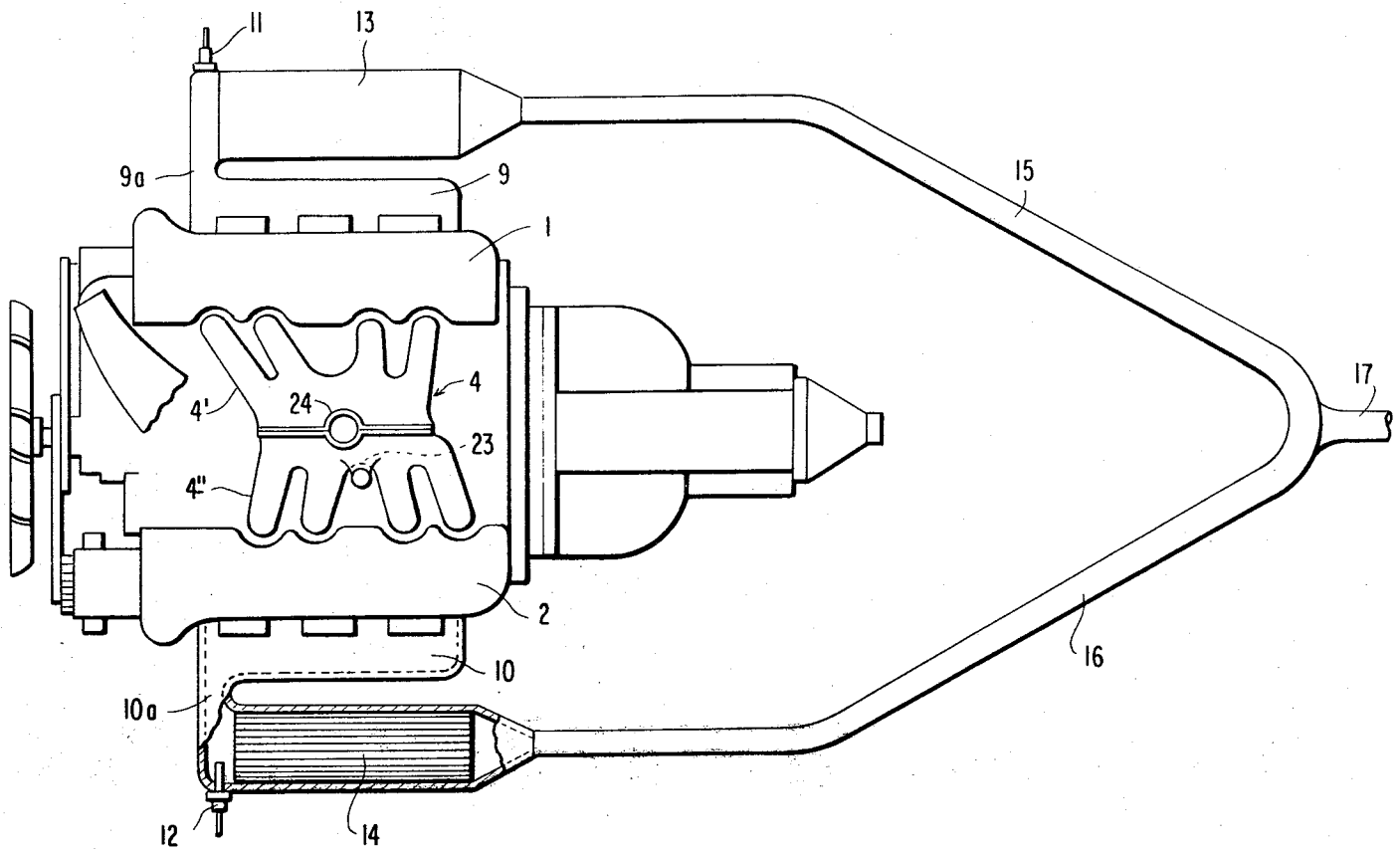

MIXTURE COMPRESSING INTERNAL COMBUSTION ENGINE WITH TWO CYLINDER ROWS AND EXHAUST GAS TREATMENT

The present invention relates to a mixture-compressing reciprocating-piston internal combustion engine including two separate cylinder rows with at least one working cylinder each as well as a uniform mixture-producing installation common to both cylinder rows, connected with the working cylinders of both cylinder rows by way of a suction channel system and having a controllable fuel supply, as well as at least one exhaust gas catalyst for the after-burning of the engine gases arranged in an exhaust gas line system of the engine as well as one separate exhaust gas manifold system for each cylinder row which collects into a uniform flow cross section the exhaust gases of the working cylinders of a respective cylinder row prior to the inlet thereof into the coordinated catalyst.

It is necessary in internal combustion engines for an optimum operation of the exhaust gas catalysts and for the fullest possible combustion of all harmful components in the exhaust gas, to maintain the air/fuel ratio within a tolerance limit of ± 1 to 2% within the range of the stoichiometric value. This cannot be achieved alone by means of the adjusting possibilities of prior art mixture-producing installations. Instead it is known in connection therewith to measure for that purpose the oxygen concentration in the exhaust gas by means of an oxygen probe arranged in the exhaust gas line and to interact by means of this measurement signal on the air/fuel ratio. It is thereby both known (compare SAE 73 0566) to interact on the fuel supply, as also to admix additional air on the engine suction side corresponding to the oxygen deficiency as determined in the exhaust gas (compare German Offenlegungsschrift No. 2,411,874).

With two-row engines of the aforementioned type having a single uniform mixture preparation installation for both cylinder rows, this type of the constancy control of the air/fuel mixture is not applicable and more particularly for the following reasons: The centrally formed mixture cannot be distributed in the suction channel system true-to-the mixture to the two cylinder rows, at least not within the requisite accuracy limits. The arrangement of a single uniform exhaust gas catalyst remote from the engine corresponding to the single mixture-producing device would, however, with a corresponding application of that which is known from the in-line engine, make necessary an oxygen probe downstream of the combining place of the exhaust gas manifolds coming from the individual cylinder rows. However, at that place the exhaust gas is already too cold for measurement purposes or the dead periods become excessive. This is so as the oxygen concentration of the exhaust gases can be measured only at places near the engine, at which the exhaust gases are still hot above 500° C., because the oxygen probes operate completely satisfactorily only above this temperature.

A prior art proposal (German Offenlegungsschrift No. 2,255,874) is concerned with the exactly identical supply of the two cylinder rows of an engine from a central mixture-producing installation. The oxygen concentrations are thereby determined by means of an oxygen probe at hot places near the engines in the exhaust gas manifolds of both cylinder rows. The central mixture-producing device is adjusted lean, i.e., slightly below stoichiometric and one injection device each is arranged in the parts of the suction channel system belonging to a respective cylinder row for the separate enrichment of each of the two partial flows to the exact stoichiometric value of the air/fuel ratio. Though this arrangement promises to be satisfactory functionally, it is very expensive since in addition to a complete mixture-preparation installation, additionally two injection installations are required.

It is the aim of the present invention to reduce the expenditures with an exactly uniform and mixture-true fuel-supply of two cylinder rows as compared to the expenditures required in the prior art construction.

Starting with the engine of the aforementioned type, this task is solved according to the present invention in that the exhaust gas catalyst or catalysts are constructed as selective catalysts, in that one oxygen probe each producing an electrical signal dependent in its magnitude from the value of the air/fuel ratio is arranged in the uniform flow cross section of the exhaust gas manifold system of each cylinder row and in that one oxygen probe is in operative connection at least indirectly with the fuel supply of the mixture-producing installation in such a manner that the air/fuel mixture fed to this one cylinder row is composed stoichiometrically as accurately as possible, and in that the other oxygen probe is operatively connected at least indirectly with an adjustable valve which is arranged in a by-pass line supplying additionally air and terminating downstream of the mixture-producing device in the corresponding part of the suction channel system, whereby the operative connection of this other oxygen probe with the valve is so constructed that also the air/fuel mixture fed to the cylinder row associated with this other oxygen probe is composed stoichiometrically as accurately as possible.

Recently a type of catalyst has become commercially available under the designation selective catalyst which with an accurate maintenance of the stoichiometric air/fuel ratio far-reachingly oxidizes and reduces all three types of exhaust gas components, namely, hydrocarbons, carbon monoxide and nitrogen oxides. In the U.S.A., this type of catalyst is known also under the designation "three-way catalyst".

The present invention makes a virtue out of necessity, so to speak of, and utilizes the disadvantage of a non-uniform mixture distribution of the suction channel system in a useful manner for the purposes of the present invention. By reason of this distribution not true to the mixture, one of the cylinder rows is supplied with a leaner mixture than the other cylinder row. The installation is now so operated that the leaner values of the air/fuel ratio correspond to the stoichiometric value, whereas the other side then initially receives an excessively rich mixture. This rich mixture is also leaned down to a stoichiometric mixture ratio by the intentional supply of additional air. Owing to the present invention, in addition to a controllable mixture-preparation installation, necessary anyhow, and in addition to the two oxygen probes, only a controllable valve and a by-pass line are required.

The oxygen probe is appropriately constructed as conventional platinum-plated zirconium dioxide electrode. The characteristic curves of this type of oxygen probe has a very steep configuration within the range of the stoichiometric oxygen concentrations so that the electrical signal with only slight changes of the oxygen oncentration changes very strongly. The requisite accuracies of a stoichiometric air/fuel ratio of about ± 1 to 2% can be readily maintained by the use of this type of oxygen probe.

In order not to have to determine continuously under all operating conditions which cylinder row is supplied by way of the suction pipe system with the richer mixture proportion and which with the leaner mixture proportion, it is appropriate if the suction channel system is constructed asymmetrically in such a manner that one cylinder row receives under all operating conditions of the engine a richer air/fuel mixture than the other cylinder row. An intentionally unequal mixture distribution to the two cylinder rows can be achieved also by an unequal design of the control periods of the inlet valves of the one cylinder row with respect to the inlet valves of the other cylinder row. The oxygen probe influencing the fuel supply can then be arranged always in the exhaust gas manifold system of the cylinder row supplied with the leaner air/fuel mixture, and the oxygen probe influencing the additional air supply can then be arranged always in the exhaust gas manifold system of the cylinder row supplied with richer air/fuel mixture, and the by-pass line may terminate in the part of the suction channel system supplied with the richer air/fuel mixture.

Accordingly, it is an object of the present invention to provide a mixture-compressing internal combustion engine with two cylinder rows and exhaust gas after-treatment which avoids by simple means the aforementioned shortcomings and drawbacks encountered in the prior art.

Another object of the present invention resides in a mixture-compressing internal combustion engine with two cylinder rows and exhaust gas after-treatment in which the air/fuel mixture can be accurately maintained within given tolerances by the use of a single mixture-producing device, utilizing relatively few and simple controls.

A further object of the present invention resides in a mixture-compressing internal combustion engine with two cylinder rows and exhaust gas after-treatment which is relatively simple in construction, yet produces highly satisfactory results as to the maintenance of the stoichiometric fuel/air ratio in the two cylinder rows.

Still another object of the present invention resides in a mixture-compressing internal combustion engine with two cylinder rows and exhaust gas after-treatment which makes possible the use of a single mixture-producing device for both rows, yet reduces the number of controls necessary to maintain the air/fuel ratio constant within relatively narrow limits for purposes of both rows.

Figure 2:
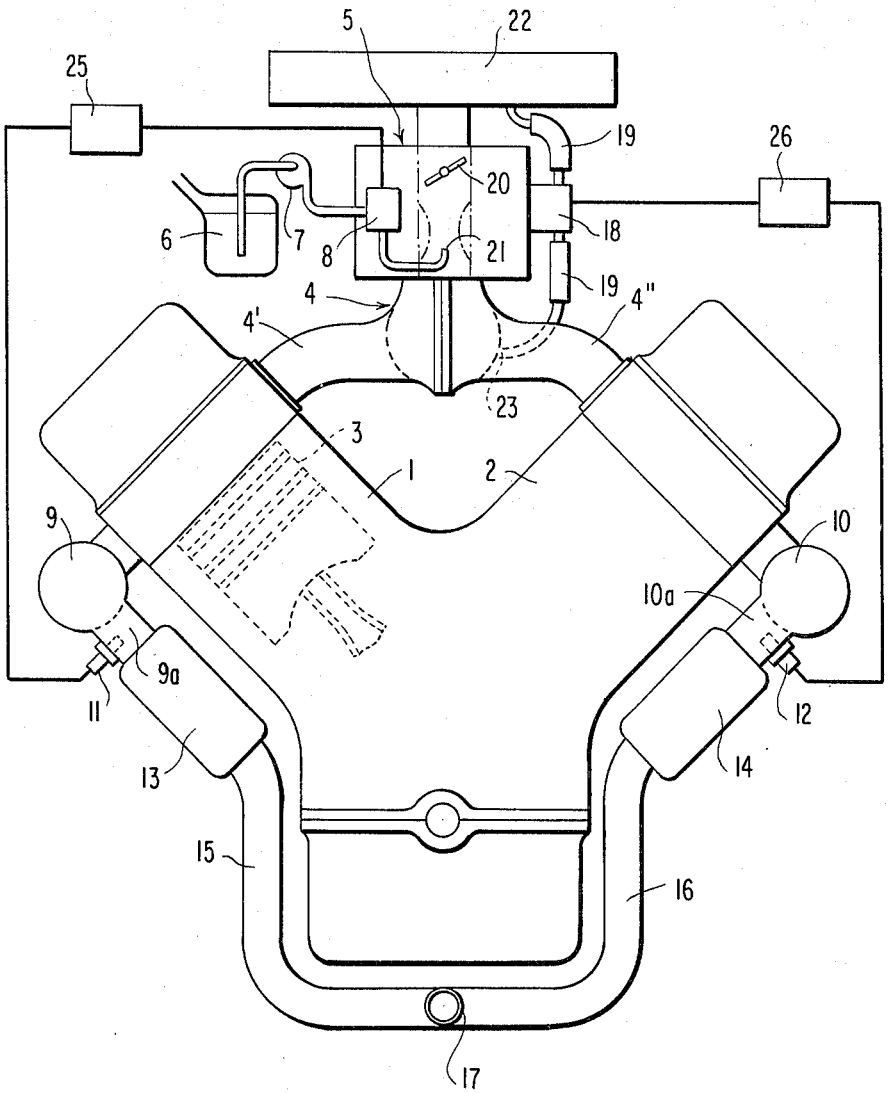

These and other objects, features and advantages of the present invention will become more apparent from the following description when taken in connection with the accompanying drawing which shows, for purposes of illustration only, one embodiment in accordance with the present invention, and wherein:

FIG. 1 is a somewhat schematic plan view on a two-row internal combustion engine with central mixture production in accordance with the present invention; and FIG. 2 is a somewhat schematic end elevational view of the engine according to FIG. 1.

Referring now to the drawing wherein like reference numerals are used throughout the two views to designate like parts, the internal combustion engine illustrated in the two figures includes two separate cylinder rows 1 and 2, whose working cylinders 3 provided with reciprocating pistons are supplied with air/fuel mixture from a common mixture-producing installation generally designated by reference numeral 5 (FIG. 2) by way of a suction channel system generally designated by reference numeral 4. The suction channel system 4 is constructed asymmetrically as can be seen quite clearly from FIG. 1. This asymmetry results already alone from the reason of the offset of the working cylinders in the cylinder row 1 with respect to those of the cylinder row 2. The almost unavoidable asymmetry is intentionally utilized for the purposes of the present invention. More particularly, it is effective in such a manner that the air/fuel mixture is not distributed true-to-mixture to the two cylinder rows and the working cylinders of one cylinder row receive together on the average a somewhat richer mixture than those of the other. The asymmetry of the suction pipe is so great that this non-uniform supply of the two cylinder rows remains preserved tendentially in all operating conditions of the engine and does not possibly reverse, i.e., the lean cylinder row remains always the same. Such a construction is well known to a person skilled in the art without special indication since alone the suction pipe asymmetry resulting from the cylinder offset is already effective in the desired direction. The person skilled in the art only has to add a slight additional asymmetry in order to prefer one cylinder row.

A controllable fuel metering valve 8 supplied from the gas tank 6 by means of the pump 7 is provided in the mixture-producing installation 5, (FIG. 2) which by means of a more or less strong electrical signal permits a correspondingly large gasoline quantity to flow therethrough.

The exhaust gases produced by the two cylinder rows are conducted into atmosphere by way of an exhaust gas line system. The latter includes one separate exhaust gas manifold 9 and 10 per each cylinder row which collect respectively the exhaust gases of a cylinder row into a respectively uniform flow cross section 9*a* and 10*a* located near the engine, at which the exhaust gases are still very hot so that one oxygen probe 11 and 12 each can be arranged at these places. The oxygen probes 11 and 12 require for their effectiveness, temperatures above about 400° to 500° C. A mixture of the exhaust gases out of the cylinders of a cylinder row is present on the average per unit time at the collecting places 9*a* and 10*a*, respectively. Any possible mixture adulterations or falsifications of the air/fuel mixture on the inside of the half of the suction channel system 4 belonging to one cylinder row in relation to the individual working cylinders of the associated cylinder row are again compensated for—at least on the average per unit time—by the collection of the exhaust gases of these working cylinders into a uniform flow cross section 9*a* and 10*a*. For a certain intermixing of the exhaust gases coming from the individual working cylinders of a cylinder row among each other, a certain larger volume is provided in the exhaust gas manifold for the equalization of the oxygen concentrations than would be necessary for the mere gas conduction. Decisive for the operation of the present invention is less an extremely accurate stoichiometric supply of each individual working cylinder but above all the fact that the exhaust gas mixture supplied to the exhaust gas catalysts to be described more fully hereinafter, is composed very accurately stoichiometrically as regards its still oxidizable or reduceable components. With a number of catalysts, this condition, however, is to be maintained for each catalyst individually.

The oxygen probes are constructed as zirconium dioxide layers platinum-plated mesh-like on both sides, whose one side faces the exhaust gases and whose other side faces the atmosphere. Both platinum platings are provided with line connections leading to the outside. These probes produce a different electrical potential at the line connections depending on the oxygen concentration or oxygen partial pressure in the exhaust gas, whereby this signal changes very strongly within the range of stoichiometric oxygen concentrations whereas it changes only very little as to the rest. The composition and application of such probes is known in the prior art and is described, inter alia, in the prior publications already mentioned hereinabove.

In the illustrated embodiment of the two-row internal combustion engine, one exhaust gas catalyst 13 and 14 through which flow the exhaust gases, is provided for each cylinder row near the engine. The catalyst is arranged downstream of the associated oxygen probe as viewed in the flow direction so that the respective exhaust gases flow past the oxygen probe in the untreated condition and the oxygen concentration is measured in the untreated condition. The catalyst may be a conventional single bed catalyst and is preferably constructed as selective catalyst. It converts all three harmful components into non-harmful components. The exhaust gas composition of the treated exhaust gases depends very strongly from the air/fuel ratio of the mixture on the engine inlet side. A nearly complete conversion of all three types of harmful components into non-harmful components takes place only with a very accurate maintenance of a stoichiometric air/fuel composition.

After flowing through the exhaust gas catalysts, the treated and purified exhaust gases reach by way of the separate lines 15 and 16 the common exhaust line 17 and from there reach atmosphere by way of mufflers (not shown).

A by-pass line 19 (FIG. 2) for the additional air which is provided with an electrically controllable valve 18 is additionally arranged at the mixture-producing device 5. The by-pass line 19 by-passes the mixture-producing device 5 and connects a place upstream of the throttle valve 20 and of the gasoline feed nozzle 21 which, however, is located downstream of the air filter 22, as viewed in the direction of the flow, with a place 23 in the suction channel system 4.

The discharge place 23 of the by-pass line 19 in the suction channel system is located asymmetrically on that half 4'' (at the cylinder row 2) which according to experience receives always a somewhat richer mixture than the opposite half 4' (at the cylinder row 1) of the suction channel system. The discharge place 23, however, is moved on the inside of the one half 4'' of the suction channel system as close to the supply place 24 common to both halves of the mixture produced by the installation 5 so that the additional air can reach all individual cylinders of the cylinder row 2.

For the uniform admission of both cylinder rows 1 and 2 from a common uniform mixture-producing installation, the one oxygen probe 11 of the one cylinder row 1 (of the "leaner" cylinder row) which is supplied by way of the one-half 4' of the suction channel system 4 with a somewhat leaner air/fuel mixture, is connected with the fuel metering apparatus 8 of the mixture-producing installation indirectly under interconnection of an electronic control apparatus 25 (FIG. 2) of conventional construction. In a similar manner, the other oxygen probe 12 of the "richer" cylinder row 2 is operatively connected indirectly with the controllable additional air valve 18 by way of an electronic control apparatus 26 again of conventional construction.

The control apparatus 25 for the fuel metering valve 8 is so constructed that it changes the fuel supply in the opposite sense analogous to the magnitude of the output signal of the "leaner" oxygen probe 11 so that with a slight air excess (low electrical output signal) slightly more fuel is supplied and vice-versa. The consequence thereof is that the "leaner" cylinder row is supplied continuously with an exactly stoichiometrically composed air/fuel mixture and accordingly the catalyst 13 of the leaner cylinder row can operate in an optimum manner.

The control apparatus 26 for the additional air valve 18 is so constructed that it releases additional air correspondingly analogous to the magnitude of the output signal of the oxygen probe 12 of the "richer" cylinder row 2 so that with a slight air deficiency (high electrical output signal), the additional air valve 18 is opened and vice versa. As a result thereof, the mixture which is conducted through the one suction channel system half 4'' in a not completely mixture-true manner, i.e., slightly excessively rich compared to the stoichiometrically produced mixture, is intentionally leaned down by the admixture of additional air again to the stoichiometric mixture composition so that also the cylinder row 2 is continuously supplied with an accurately stoichiometrically composed mixture, notwithstanding the non-uniform mixture distribution, and the associated exhaust gas catalyst can also operate in an optimum manner.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A mixture-producing reciprocating-piston internal combustion engine which comprises at least two cylinder rows each having at least one working cylinder means, a mixture-producing means common to both cylinder rows having a controllable fuel supply means and operatively connected with the working cylinder means of the two rows by way of suction channel means, exhaust gas catalyst means for the after-burning of the exhaust gases arranged in exhaust gas line means of the engine, and a separate exhaust gas manifold means for each cylinder row, characterized in that an oxygen probe means is arranged in the exhaust gas manifold means of each cylinder row and is operable to produce an electrical signal dependent in its magnitude from the value of the air/fuel ratio, one of the oxygen probe means being at least indirectly operatively connected with the controllable fuel supply means of the mixture-producing means in such a manner that the air/fuel ratio supplied to one cylinder row is maintained substantially constant within given limits, and in that the other oxygen probe means is operatively connected at least indirectly with a controllable additional air supply means which is arranged in a by-pass line means conducting additional air and terminating downstream of the mixture-producing means in the corresponding part of the suction channel means, the operative connection of said other oxygen probe means with the additional air supply means being such that the air/fuel mixture conducted to the other cylinder row belonging to said other oxygen probe means is also held substantially constant within the given tolerances.

2. An engine according to claim 1, characterized in that the exhaust gas catalyst means is constructed as selective catalyst means, and in that the one oxygen probe means is operatively connected at least indirectly with the controllable fuel supply means of the mixture-producing means in such a manner that the air/fuel ratio supplied to the one cylinder row is composed as accurately as possible stoichiometrically while the operative connection of the other oxygen probe means with the additional air supply means is such that the air/fuel mixture supplied to the other cylinder row associated with said other oxygen probe means is composed also stoichiometrically as accurately as possible.

3. An engine according to claim 2, characterized in that each exhaust gas manifold means collects the exhaust gases of the working cylinder means of a respective cylinder row prior to the inlet thereof into the associated catalyst means into a uniform flow cross section, and in that the oxygen probe means are arranged in the uniform flow cross section of the exhaust gas manifold means of a given cylinder row.

4. An engine according to claim 3, characterized in that the controllable additional air supply means includes a variable valve means.

5. An engine according to claim 4, characterized in that the oxygen probe means are constructed as platinum-plated zirconium dioxide electrodes.

6. An engine according to claim 4, characterized in that the suction channel means is constructed asymmetrically in such a manner that one cylinder row receives under all operating conditions of the engine, a richer air/fuel mixture than the other cylinder row, and in that the oxygen probe means influencing the controllable fuel supply means is arranged in the exhaust gas manifold means of the cylinder row supplied with the leaner air/fuel mixture and the oxygen probe means influencing the additional air supply means is arranged in the exhaust gas manifold means of the cylinder row supplied with richer air/fuel mixture, and in that the by-pass line means terminates in the part of the suction channel means supplied with the richer air/fuel mixture.

7. An engine according to claim 6, characterized in that the oxygen probe means are constructed as platinum-plated zirconium dioxide electrodes.

8. An engine according to claim 1, characterized in that each exhaust gas manifold means collects the exhaust gases of the working cylinder means of a respective cylinder row prior to the inlet thereof into the associated catalyst means into a uniform flow cross section, and in that the oxygen probe means are arranged in the uniform flow cross section of the exhaust gas manifold means of a given cylinder row.

9. An engine according to claim 1, characterized in that the suction channel means is constructed asymmetrically in such a manner that one cylinder row receives under all operating conditions of the engine, a richer air/fuel mixture than the other cylinder row, and in that the oxygen probe means influencing the controllable fuel supply means is arranged in the exhaust gas manifold means of the cylinder row supplied with the leaner air/fuel mixture and the oxygen probe means influencing the additional air supply means is arranged in the exhaust gas manifold means of the cylinder row supplied with richer air/fuel mixture, and in that the by-pass line means terminates in the part of the suction channel means supplied with the richer air/fuel mixture.

10. An engine according to claim 1, characterized in that the controllable additional air supply means includes a variable valve means.

11. A mixture-producing reciprocating-piston internal combustion engine which comprises at least two cylinder rows each having at least one working cylinder means, a mixture-producing means common to both cylinder rows having a controllable fuel supply means and operatively connected with the working cylinder means of the two rows by way of suction channel means, exhaust gas catalyst means for the after-burning of the exhaust gases arranged in exhaust gas line means of the engine, and a separate exhaust gas manifold means for each cylinder row, characterized by control means operable to supply one row with a relatively leaner, though substantially stoichiometric air/fuel mixture from said common mixture-producing means and to supply the other row with a slightly richer air/fuel mixture including means for leaning down the richer mixture so as to be also substantially stoichiometric.

12. An engine according to claim 11, characterized in that the control means include oxygen probe means in the exhaust gas line means upstream of the catalyst means.

13. An engine according to claim 12, characterized in that the control means further includes controllable additional air supply means for leaning down the richer mixture.

14. An engine according to claim 13, characterized in that the exhaust gas catalyst means is constructed as selective catalyst means, and in that the one oxygen probe means is operatively connected at least indirectly with the controllable fuel supply means of the mixture-producing means in such a manner that the air/fuel ratio supplied to the one cylinder row is composed as accurately as possible stoichiometrically while the operative connection of the other oxygen probe means with the additional air supply means is such that the air/fuel mixture supplied to the other cylinder row associated with said other oxygen probe means is composed also stoichiometrically as accurately as possible.

15. An engine according to claim 12, characterized in that each exhaust gas manifold means collects the exhaust gases of the working cylinder means of a respective cylinder row prior to the inlet thereof into the associated catalyst means into a uniform flow cross section, and in that the oxygen probe means are arranged in the uniform flow cross section of the exhaust gas manifold means of a given cylinder row.

16. An engine according to claim 13, characterized in that the suction channel means is constructed asymmetrically in such a manner that one cylinder row receives under all operating conditions of the engine, a richer air/fuel mixture than the other cylinder row, and in that the oxygen probe means influencing the controllable fuel supply means is arranged in the exhaust gas manifold means of the cylinder row supplied with the leaner air/fuel mixture and the oxygen probe means influencing the additional air supply means is arranged in the exhaust gas manifold means of the cylinder row supplied with richer air/fuel mixture, and in that the by-pass line means terminates in the part of the suction channel means supplied with the richer air/fuel mixture.

* * * * *